United States Patent [19]

Dannhäuser

[11] Patent Number: 4,973,191

[45] Date of Patent: Nov. 27, 1990

[54] MANHOLE COVER

[76] Inventor: Richard Dannhäuser, Harthöhe 5, D-6551 Wallhausen, Fed. Rep. of Germany

[21] Appl. No.: 473,111

[22] Filed: Jan. 31, 1990

Related U.S. Application Data

[63] Continuation of Ser. No. 250,972, Sep. 23, 1988, abandoned, which is a continuation of Ser. No. 900,174, Aug. 25, 1986, abandoned.

[30] Foreign Application Priority Data

Aug. 23, 1985 [DE] Fed. Rep. of Germany ..... 3530128

[51] Int. Cl.[5] ..... E02D 29/14

[52] U.S. Cl. ..... 404/25; 52/20

[58] Field of Search ..... 404/25, 26; 52/19–21; 210/163, 164, 166; 49/41, 463

[56] References Cited

U.S. PATENT DOCUMENTS

| | | | |
|---|---|---|---|
| 1,014,142 | 1/1912 | Garrison | 49/41 |
| 1,712,510 | 5/1929 | Monie | 52/20 X |
| 2,314,682 | 3/1943 | Becket | 404/25 |
| 3,046,853 | 7/1962 | Legendre | 404/25 |
| 3,408,778 | 11/1968 | Mason | 404/26 X |
| 4,048,766 | 9/1977 | Dantzer et al. | 52/19 |
| 4,145,151 | 3/1979 | Helms | 404/25 |
| 4,597,692 | 7/1986 | Gruenwald | 404/25 |
| 4,614,065 | 9/1986 | Papp | 52/20 |

FOREIGN PATENT DOCUMENTS

| | | | |
|---|---|---|---|
| 217067 | 8/1908 | Fed. Rep. of Germany . | |
| 1956898 | 1/1967 | Fed. Rep. of Germany . | |
| 1409731 | 3/1969 | Fed. Rep. of Germany . | |
| 8116892 | 10/1981 | Fed. Rep. of Germany . | |
| 839497 | 6/1960 | United Kingdom | 210/163 |

*Primary Examiner*—Stephen J. Novosad
*Assistant Examiner*—Gay Ann Spahn
*Attorney, Agent, or Firm*—Spencer & Frank

[57] ABSTRACT

A manhole cover including a frame and a lid having an insert plate on its upper surface. The lid is insertable into the frame which is provided in the road surface. Securing screws are provided for detachably securing the insert plate to the base portion of the lid from the underside of the lid. The insert plate is configured as an advertising area.

12 Claims, 4 Drawing Sheets

MANHOLE COVER

This application is a continuation of application Ser. No. 07/250,972, filed Sept. 23, 1988 now abandoned, which is a continuation of application Ser. No. 06/900,174, filed Aug. 25, 1986 now abandoned.

BACKGROUND OF THE INVENTION

1. Field of the Invention

The invention relates to a manhole cover including a frame and a lid which is insertable in the frame and is provided with an insert plate on its upper surface.

The frame of such a manhole cover is inserted into the road surface and the lid is inserted into the frame and locked therein so that, when subjected to stress, it does not move or, worse yet, lift off from the frame. The frame and the lid of the manhole cover are customarily made of cast iron and it is known to provide profiled portions on the upper surface of the lid to improve the non-slip characteristics thereof, such profiled portions being produced simultaneously, if the lids are produced by casting, during the casting process. The profiled portions consist of irregularly disposed projections, such as, for example, protruding ribs or the like. These grid-like profiles which have closed, rectangular or square openings, are easily clogged with road dirt and are very difficult to clean. Furthermore, the grid-like profiles wear down after a period of time with the result that they are no longer safe for traffic, and then the entire lid must be replaced. In addition, the monotonous grid-like profiles spoil the appearance of the road, especially in pedestrian zones. Likewise, the same applies to manhole covers whose lids are filled with concrete or the like. In this case also, it is necessary to replace the entire lid once the concrete filling has become worn, and the concrete filling does not provide the lid with an attractive appearance.

2. Discussion of the Prior Art

A manhole cover including a frame and lid which have on their surfaces a corrugation formed of raised portions and grooves separating the raised portions from one another is disclosed in German Gebrauchsmuster (Utility Model) No. 1,956,898, wherein, if the lid is filled with concrete, the raised portions and grooves are provided in a corrugated plate which covers the concrete filling and is securely fixed thereto by anchoring means. When the raised portions of such a corrugated plate are worn down, it is necessary to replace the entire lid since the corrugated plate is securely anchored in the concrete filling. In addition, the appearance of the corrugated plate is not particularly aesthetically pleasing.

SUMMARY OF THE INVENTION

It is an object of the invention to provide a manhole cover of the above-described type which has a particularly aesthetic appearance clearly contrasting with that of prior art products and which permits the insert plate to be easily replaced while simultaneously permitting the upper surface of the insert plate to be easily cleaned.

According to the invention, this is accomplished by the fact that the upper surface of the insert plate is configured as an advertising area and is directly and detachably connected to the base of the lid.

Consequently, the lids of the manhole covers can be designed in an interesting and highly varied form, thereby advantageously altering the appearance of the road and, in particular, promoting the originality and attractiveness of a pedestrian zone. The decorative appearance of the insert plate draws considerable attention and consequently has a suitable, positive advertising effect. Since the upper surface of the insert plate is not provided with a corrugation or profiling, it can be quickly cleaned by simple means. If the insert plate must be replaced either because the advertising area has become worn or because it is desired to change the design on the advertising area, this change can be effected quickly and in a simple manner due to the detachable connection between the insert plate and the lid.

In one embodiment of the invention, the advertising area on the upper surface of the insert plate has raised portions of differing heights whereby, on the one hand, the three-dimensional effect of the designs represented on the advertising area is augmented and, on the other hand, the non-slip characteristic of the surface of the insert plate is improved.

According to a further embodiment of the invention, the insert plate my be made of bronze, brass or copper in order to permit attractive and highly varied designs to be displayed in the advertising area of the insert plate in a simple manner.

To prevent the connection between the insert plate and the base of the lid from being visible from the upper side of the insert plate, a further embodiment according to the invention provides the underside of the insert plate with blind threaded bores, in which securing screws engage by extending through the base of the lid. In such a case, the blind threaded bores are preferably distributed over the circumferential region of the insert plate with uniform spacings therebetween, thereby permitting the design for the advertising area of the insert plate to be inserted into the lid in the desired direction or, if necessary, to rotate it in the desired direction at a later date, this possibility being particularly advantageous if the direction of movement is changed in pedestrian zones.

According to a further advantageous embodiment of the invention, a secure seat and prealignment of the insert plate in the lid are realized in that each blind threaded bore is disposed in a downwardly oriented, conical projection of the insert plate, with each projection engaging in a corresponding, conical passage in the base of the lid. In such a case, a support shoulder for supporting the head of the securing screw is advisably molded to the underside of the base of the lid in association with each conical passage.

According to another advantageous embodiment of the invention, the base of the lid is provided with reinforcement ribs on its underside to make the lid sufficiently strong. Preferably, the reinforcement ribs comprise a circular rib which is centrally located in the region of the center of the lid, and four ribs which radiate from this circular rib and extend to the edge of the lid with identical spacings therebetween. Furthermore, the free end of the central rib is advisably located below the underside of the edge of the lid, and the radial ribs extend in an inclined orientation from the central rib to the edge of the lid.

In order to ensure that the lid can be easily inserted into and removed from the frame, it is advantageous to insert two oppositely disposed blind screws into the upper surface of the edge of the lid, such screws being replaceable by screws having circular eyes for moving the lid. In addition, it is advisable to join the lid to the frame by means of two oppositely disposed locking screws which are inserted into the edge of the lid so that, when subjected to stress, the lid cannot move or lift off from the frame. Finally, it is of advantage to provide the upper surfaces of the frame and of the edge of the lid with a profiled design so as to improve its non-slip characteristics.

The basic idea of the invention will be described in greater detail below with reference to an embodiment thereof which is illustrated in the drawings, in which:

DESCRIPTION OF THE PREFERRED EMBODIMENT

Figure 1:
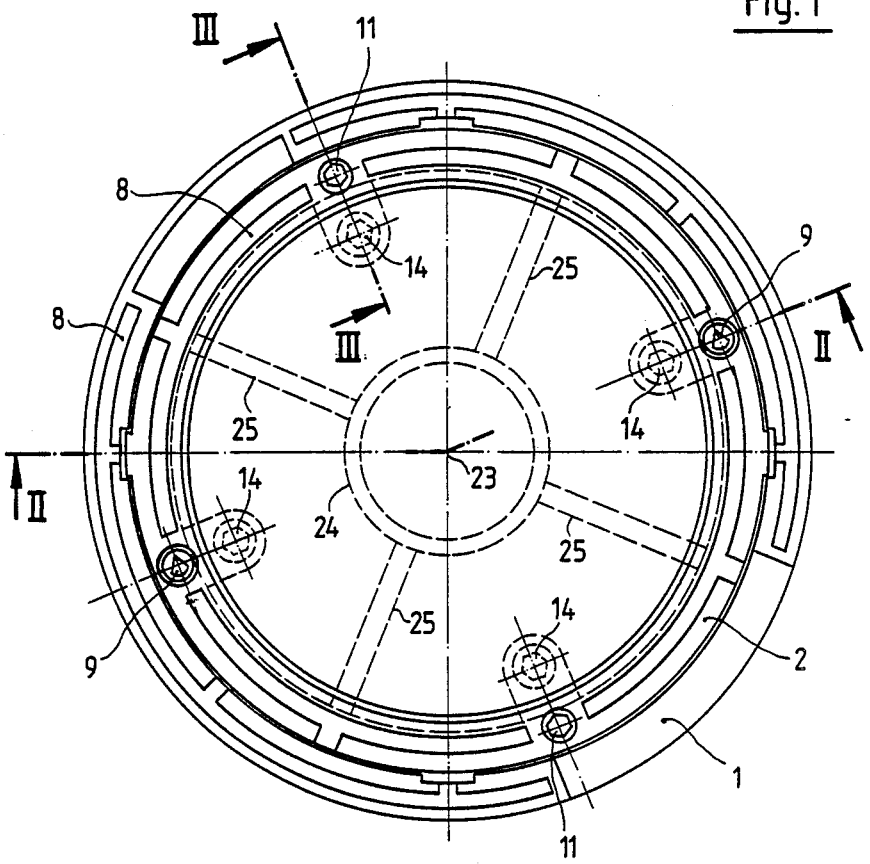
FIG. 1 is a plan view of a manhole cover according to the invention, but without a design on the advertising area on the upper side of the insert plate of the lid.
Figure 2:
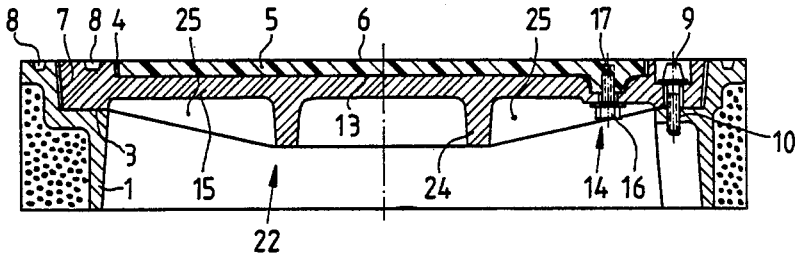
FIG. 2 is a sectional view through the manhole cover of FIG. 1, seen along line II—II.
Figure 2A:
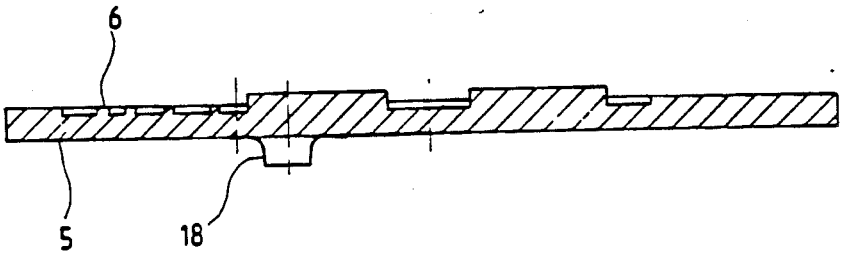
FIG. 2A is a sectional view along line V—V from FIG. 2B of an insert plate with a raised design.
Figure 2B:
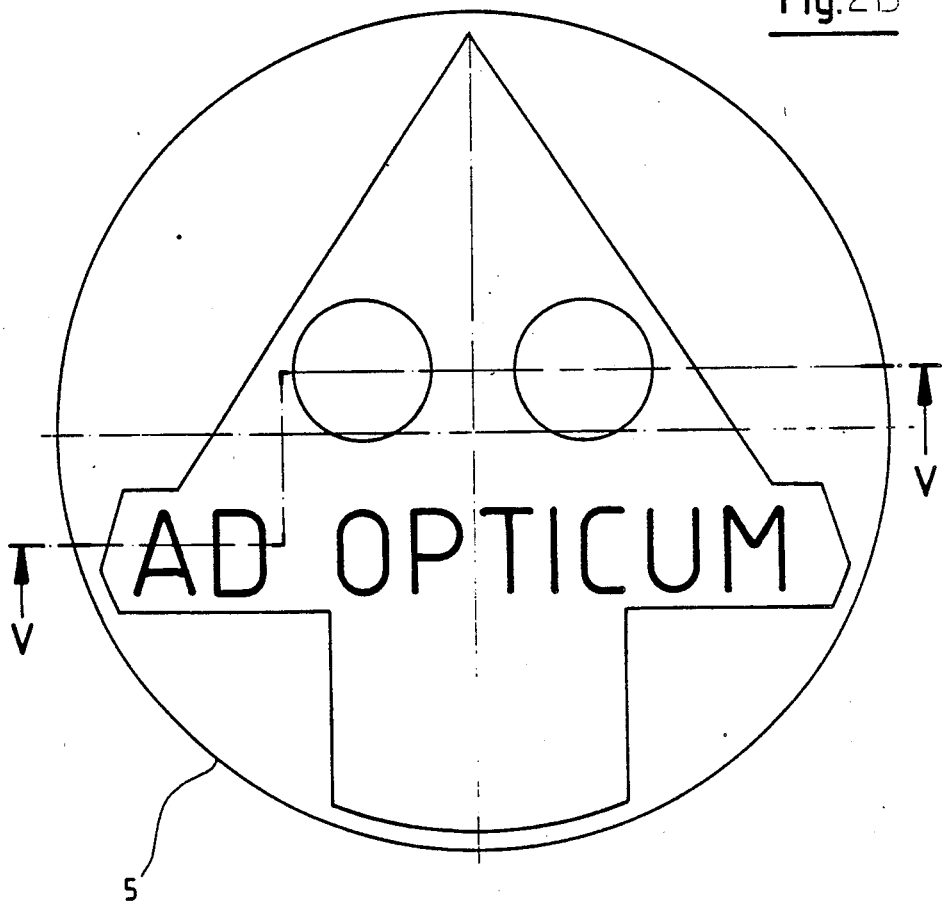
FIG. 2B is an elevational view of an insert plate with a raised design.

The manhole cover includes a frame 1 of conventional construction and a lid 2 which rests on a circumferential shoulder 3 of frame 1. On its upper surface, lid 2 has a central, circular recess 4 which accommodates an insert plate 5 whose upper surface 6 terminates flush with the edge 7 of the lid. Profiled portions 8 are provided both in the upper surface of edge 7 of the lid and in the upper surface of frame 1.

Figure 3:
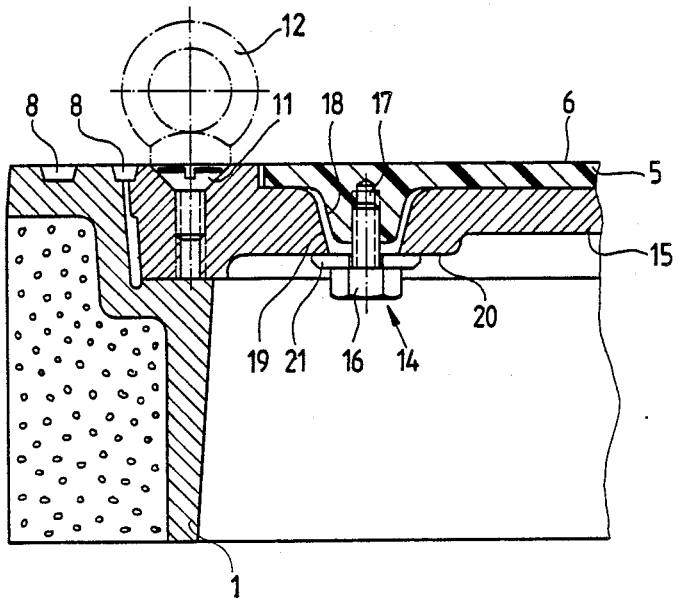
FIG. 3 is a sectional view through the manhole cover of FIG. 1, seen along line III—III.

Lid 2 is connected to frame 1 by means of two oppositely disposed locking screws 9 which are inserted into the edge 7 of the lid and engage in corresponding threaded holes 10 in shoulder 3 of frame 1. Locking screws 9 have specially shaped heads so that it is possible to turn locking screws 9 only by means of a special key. Furthermore, two oppositely disposed blind screws 11 are provided in edge 7 of the lid at identical distances from locking screws 9. To transport lid 2, blind screws 11 are replaced by screws 12 having circular eyes, one of which is shown by dotted lines in FIG. 3.

On its upper surface, insert plate 5 is configured as an advertising area, the designs on the advertising area being cast into insert plate 5 to result in a raised configuration. Insert plate 5 is made of bronze, brass or copper, thereby imparting a rich appearance to insert plate 5. However, it is also possible, of course, to produce insert plate 5 from a wear-resistant plastic. Insert plate 5 is secured to base 15 of lid 2 by means of four screw connections 14 which are arranged in the shape of a cross around the circumferential region on underside 13 of insert plate 5. The securing screws which are brought through base 15 of lid 2 engage in corresponding blind threaded bores in the underside 13 of insert plate 5. Each blind threaded bore 17 is disposed in a downwardly oriented, conical projection 18 of insert plate 5. This conical projection 18 engages in a corresponding conical passage 19 formed in base 15 of lid 2.

A supporting shoulder 20 to support the head of securing screw 16 is molded to the underside of base 15 of lid 2 and is associated with each conical passage 19, a washer 21 being provided between support shoulder 20 and the head of securing screw 16. This type of connection between insert plate 5 and lid 2, on the one hand, permits insert plate 5 to be quickly exchanged if it is desired to change the design of the advertisement and, on the other hand, permits insert plate 5 to be easily rotated if it is desired to change the viewing direction of the advertisement.

To increase the strength and, hence, the load bearing capacity of lid 2, reinforcement ribs 22 are molded to the underside of base 15 of lid 2. Reinforcement ribs 22 comprise a circular rib 24 which is centrally located with respect to the center 23 of the lid 2, and four ribs 25 which radiate from this rib 24 and extend to the edge 7 of the lid with identical spacings therebetween. Radial ribs 25 are also spaced at identical distances from the adjacent screw connections 14 between lid 2 and insert plate 5. In addition, each of the oppositely disposed screw connections 14 lies in the same plane as locking screws 9 and/or blind screws 11.

The free end of central rib 24 is located below the underside of the edge of the lid, and radial ribs 25 extend in an inclined orientation from the central rib 24 to edge 7 of the lid. Due to the provision of reinforcement ribs 22, it is possible for the thickness of the base 15 of lid 2 to be relatively thin. Furthermore, the particular arrangement of reinforcement ribs 22 assures free access to screw connections 14.

The described embodiment shows the particularly simple and easily handled structure of the manhole cover according to the invention which, in addition to being simple, also serves as a particularly effective advertising means, with it simultaneously being possible to easily exchange such advertising means.

Although the invention has been described with reference to only one embodiment, it is self-evident to the person skilled in the art that the basic concept of the present invention may have a substantially broader application and is not limited to the embodiment which is specifically described here.

I claim:

1. A manhole cover, comprising:

a frame having an outer rim and a shoulder;

a lid having an upper surface and a recess in said upper surface whereby a rim is defined in said lid, said lid being disposed on said shoulder of said frame with the upper surface of said rim being flush with the upper surface of the outer rim of said frame;

an insert plate having an upper surface provided with a raised advertising design, said insert plate being disposed in said recess of said lid such that the upper surface of said insert plate is flush with the upper surface of the rim thereof; and a screw means being effectively the exclusive means for repeatably, detachably, fastening said insert plate to said lid, whereby said insert plate is removable from said lid by said screw means and replaced.

2. Manhole cover according to claim 1, wherein the raised design on the upper surface (6) of the insert plate (5) has raised portions of varying heights.

3. Manhole cover according to claim 1, wherein the insert plate (5) is made of bronze, brass or copper.

4. Manhole cover according to claim 3, wherein said securing means are securing screws and the insert plate (5) has blind threaded bores (17) on its underside (13) in which said securing screws (16) engage, said securing screws extending through the base portion (15) of the lid (2).

5. Manhole cover according to claim 4, wherein the blind threaded bores (17) are uniformly distributed over a circumferential region of the insert plate.

6. Manhole cover according to claim 4, wherein each blind threaded bore (17) is disposed in a downwardly oriented, conical projection (18) of the insert plate (5), said projection engaging in a corresponding conical passage (19) provided in the base portion (15) of the lid.

7. Manhole cover according to claim 6, wherein each conical passage (19) includes a support shoulder (20) molded to an underside of the base portion (15) of the lid (2) to support the head of the securing screw (16).

8. Manhole cover according to claim 1, wherein an underside of the base (15) of the lid (2) is provided with reinforcement ribs (22).

9. Manhole cover according to claim 8, wherein the reinforcement ribs (22) comprise a circular rib (24) which is centrally located with respect to the center (23) of the lid (2) and four ribs (25) which radiate from said circular rib (24) and extend to the edge (7) of the lid with identical spacings therebetween.

10. Manhole cover according to claim 9, wherein the free end of the central rib (24) is located below the underside of the edge (7) of the lid and the radial ribs (25) extend in an inclined orientation from the central rib (24) to the edge (7) of the lid.

11. The manhole cover of claim 1, further comprising a means for locking said lid in said frame.

12. The manhole cover of claim 11, wherein said means for locking comprises at least one locking screw, having a specially shaped head which may only be turned by means of a special key.

* * * * *